US009538792B2

(12) United States Patent
Essery

(10) Patent No.: US 9,538,792 B2
(45) Date of Patent: Jan. 10, 2017

(54) SHIRT RETAINING WAISTBAND FOR UNDERGARMENT

(71) Applicant: Zachariah Cameron Essery, Columbia (CA)

(72) Inventor: Zachariah Cameron Essery, Columbia (CA)

( * ) Notice: Subject to any disclaimer, the term of this patent is extended or adjusted under 35 U.S.C. 154(b) by 62 days.

(21) Appl. No.: 14/682,367

(22) Filed: Apr. 9, 2015

(65) Prior Publication Data

US 2016/0295927 A1 Oct. 13, 2016

(51) Int. Cl.
*A41B 9/14* (2006.01)
*A41B 9/02* (2006.01)
*A41B 9/04* (2006.01)

(52) U.S. Cl.
CPC . *A41B 9/14* (2013.01); *A41B 9/02* (2013.01); *A41B 9/04* (2013.01); *A41B 2400/80* (2013.01); *A41B 2500/50* (2013.01)

(58) Field of Classification Search
CPC ..... A41B 9/02; A41B 9/04; A41B 9/14; A41B 2400/80; A41B 250/50; A41F 9/00
USPC ..... 2/403, 236, 402
See application file for complete search history.

(56) References Cited

U.S. PATENT DOCUMENTS 932,640 A 8/1909 Pfiffner
1,052,304 A * 2/1913 Baker et al. ..... A41F 9/00 2/236
1,519,878 A * 12/1924 Pugatsky ..... A41F 9/00 2/220
2,027,987 A * 1/1936 Reis ..... A41B 9/02 2/402
2,258,502 A * 10/1941 Perez ..... A41D 7/005 2/402
2,508,049 A 5/1950 Tuck
2,619,651 A * 12/1952 Leonard ..... A41F 9/00 2/320
2,677,828 A * 5/1954 Evans ..... A41B 9/14 2/237

(Continued)

FOREIGN PATENT DOCUMENTS

CN 202800123 3/2013

OTHER PUBLICATIONS

Stuck Boxer Brief Underwear, ribbedtee.com/store/product/stuck-boxer-brief-underwear-cotton, accessed Mar. 14, 2015.

*Primary Examiner* — Shaun R Hurley
*Assistant Examiner* — Bao-Thieu L Nguyen

(57) ABSTRACT

An undergarment for inhibiting unwanted movement of a shirt during wear can include a body, a torso opening, and a waistband. The body can have an interior side and an exterior side. The torso opening can be defined at a top of the body and a pair of leg openings can be defined at a bottom of the body. The waistband can extend along a circumference of the top. The waistband can include an exterior surface at least partially covered with a garment movement-inhibiting material configured to prevent sliding movement of a shirt across the exterior surface. The waistband can also include an interior surface at least partially covered with a garment non-inhibiting material. The waistband can be circumferentially foldable towards the bottom to selectively expose one of the garment movement-inhibiting material and the garment non-inhibiting material.

17 Claims, 3 Drawing Sheets

(56) References Cited

U.S. PATENT DOCUMENTS 3,478,748 A * 11/1969 Bjorn-Larsen ..... A41C 1/003 2/240
3,488,778 A * 1/1970 Ivan ..... A41B 9/001 2/402
3,554,195 A * 1/1971 Murdoch ..... A61F 13/60 2/402
3,930,090 A * 12/1975 Campbell, Sr. ..... A41F 9/00 2/221
4,074,364 A 2/1978 Lucero
4,893,358 A * 1/1990 Bice, Jr. ..... A41F 9/025 2/221
4,937,886 A 7/1990 Ellis
5,177,813 A 1/1993 Bosack
5,210,882 A * 5/1993 Moretz ..... A41B 9/004 2/400
5,243,974 A * 9/1993 Allen ..... A41B 9/02 128/891
5,276,923 A 1/1994 Cohen
5,561,865 A * 10/1996 Fjelstul ..... A41D 27/20 2/227
5,754,982 A 5/1998 Gainer
5,802,612 A * 9/1998 Hosking ..... A41F 5/00 2/107
5,867,836 A * 2/1999 Quinones ..... A41F 9/02 2/221
5,921,976 A * 7/1999 Seymore ..... A41B 9/12 2/46
6,041,446 A * 3/2000 Braunstein ..... A41B 9/004 2/400
6,108,823 A * 8/2000 Danes ..... A41B 13/04 2/400
6,253,384 B1 * 7/2001 Valentino ..... A41F 9/00 2/229
6,332,825 B1 * 12/2001 Henricksen ..... A41C 3/0057 450/1
6,412,119 B1 * 7/2002 Robles ..... A41B 9/007 2/400
6,526,597 B1 * 3/2003 Shepard ..... A41F 9/00 2/236
6,657,099 B1 * 12/2003 Underhill ..... A61F 13/42 604/361
6,789,270 B1 * 9/2004 Pedrick ..... A41D 7/005 2/228
7,065,797 B1 * 6/2006 Chen ..... A41B 9/02 2/400
7,122,236 B2 * 10/2006 Mitchell ..... A41F 15/02 2/459
7,404,216 B1 * 7/2008 Paramore ..... A63B 71/1216 2/406
7,774,865 B2 * 8/2010 Miller ..... A41B 9/02 2/400
7,793,359 B2 * 9/2010 Spiewak ..... A41D 1/002 2/247
8,082,598 B2 * 12/2011 Simpson ..... A41B 9/14 2/400
8,117,675 B2 * 2/2012 Strange ..... A41B 17/00 2/400
8,122,520 B2 * 2/2012 Wilson, II ..... A41D 1/08 2/220
8,601,615 B2 12/2013 Isaacson
8,990,965 B2 * 3/2015 Waldman ..... A41D 27/02 2/69
2005/0235397 A1 * 10/2005 Cosenza ..... A01M 1/14 2/242
2005/0268379 A1 * 12/2005 MacGeorge ..... A41F 9/02 2/400
2007/0033708 A1 * 2/2007 Mars ..... A41F 9/007 2/237
2009/0098803 A1 * 4/2009 Reinisch ..... A41C 3/0057 450/39
2009/0139014 A1 * 6/2009 Trochlil-Crist ..... A41F 9/002 2/338
2009/0271914 A1 * 11/2009 Bauer ..... A41B 9/001 2/401
2010/0175166 A1 * 7/2010 Bradt ..... A41F 9/00 2/236
2010/0186149 A1 7/2010 Miller
2011/0179556 A1 * 7/2011 Partovi ..... A41F 7/00 2/406
2013/0227758 A1 9/2013 Doney
2014/0075651 A1 3/2014 Jones
2014/0304899 A1 * 10/2014 Almonte ..... A41B 9/001 2/403
2015/0094639 A1 * 4/2015 Diamond ..... A61F 5/40 602/70
2015/0272247 A1 * 10/2015 Shoraka ..... A41C 1/08 2/107

* cited by examiner

SHIRT RETAINING WAISTBAND FOR UNDERGARMENT

BACKGROUND

1. Field

The present disclosure relates to an undergarment, and more particularly to an undergarment that selectively retains a shirt that has been tucked into an outer garment.

2. Description of Related Prior Art

U.S. Pat. No. 7,122,236 discloses a clothes securing system. Disclosed is a fabric securing system having a strip of flexible material for securing two pieces of fabric or clothing is disclosed. The system has at least a portion of one of its sides containing an adhesive material. Both sides of the system may contain an adhesive portion. U.S. Pat. No. 2,677,828 discloses an undergarment and waistband therefor. Disclosed is an undergarment having a waistband comprising a base fabric having longitudinal stretch, in combination with a bare elastic thread interwoven longitudinally into the base fabric so as to form loops exposed on at least one face of the fabric, of such length that their thread is slack when the base fabric is stretched, whereby when the garment is being worn, limited up-and-down movement of the loops is permitted and a quality of holding down other garments is created even when the base fabric is stretched.

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

SUMMARY

An undergarment for inhibiting unwanted movement of a shirt during wear can include a body, a torso opening, and a waistband. The body can have an interior side and an exterior side. The torso opening can be defined at a top of the body and a pair of leg openings can be defined at a bottom of the body. The waistband can extend along a circumference of the top. The waistband can include an exterior surface at least partially covered with a garment movement-inhibiting material configured to prevent sliding movement of a shirt across the exterior surface. The waistband can also include an interior surface at least partially covered with a garment non-inhibiting material. The waistband can be circumferentially foldable towards the bottom to selectively expose one of the garment movement-inhibiting material and the garment non-inhibiting material.

BRIEF DESCRIPTION OF THE DRAWINGS

The detailed description set forth below references the following drawings.

DETAILED DESCRIPTION

Figure 1:
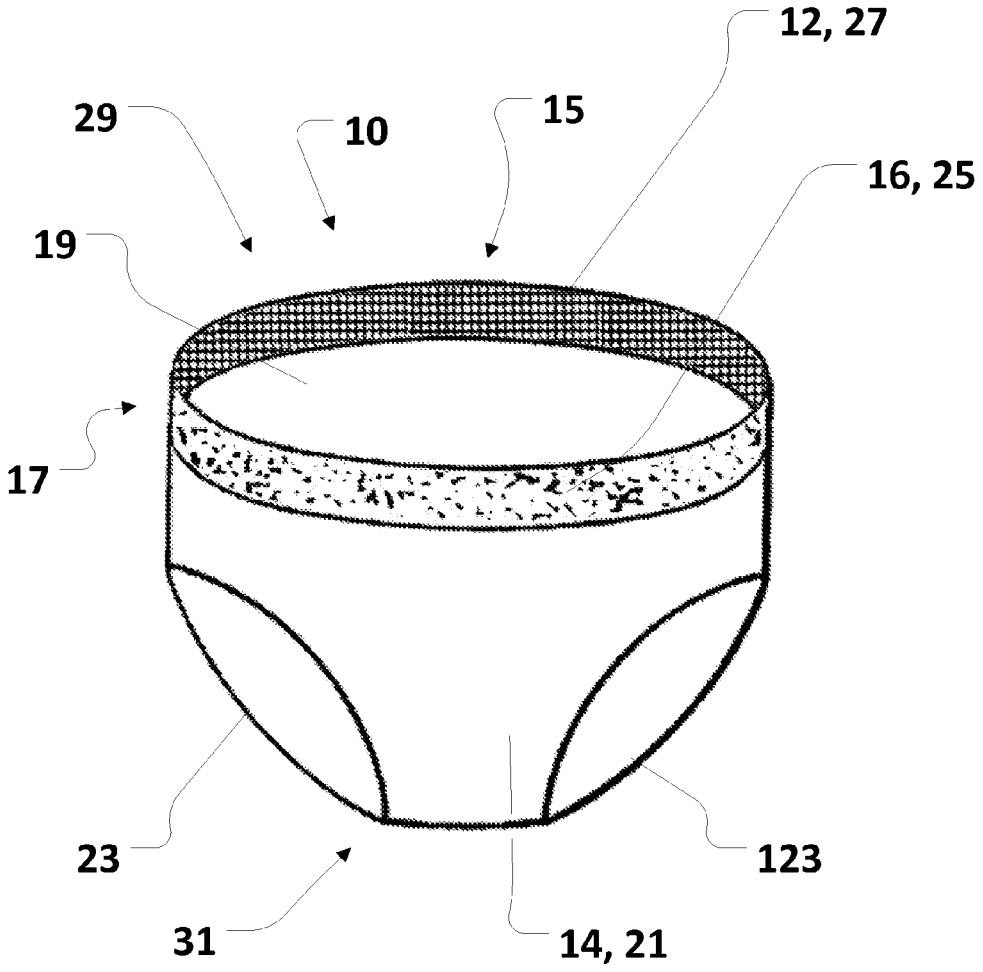
FIG. 1 is a perspective view of a garment in the form of a brief according to an exemplary embodiment of the present disclosure.

A plurality of different embodiments of the present disclosure is shown in the Figures of the application. Similar features are shown in the various embodiments of the present disclosure. Similar features across different embodiments have been numbered with a common reference numeral and have been differentiated by an alphabetic suffix. Similar features in a particular embodiment have been numbered with a common two-digit, base reference numeral and have been differentiated by a different leading numeral. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The present disclosure, as demonstrated by the exemplary embodiments described below, can provide the wearer with the choice to selectively inhibit unwanted movement of a tucked in shirt. An undergarment 10 in the form of a brief for inhibiting unwanted movement of a shirt during wear can include a body 14, a torso opening 15, and a waistband 17. The body 14 can have an interior side 19 and an exterior side 21. The torso opening 15 can be defined at a top 29 of the body 14 and a pair of leg openings 23, 123 can be defined at a bottom 31 of the body 14. The waistband 17 can extend along a circumference of the top 29.

Figure 2:
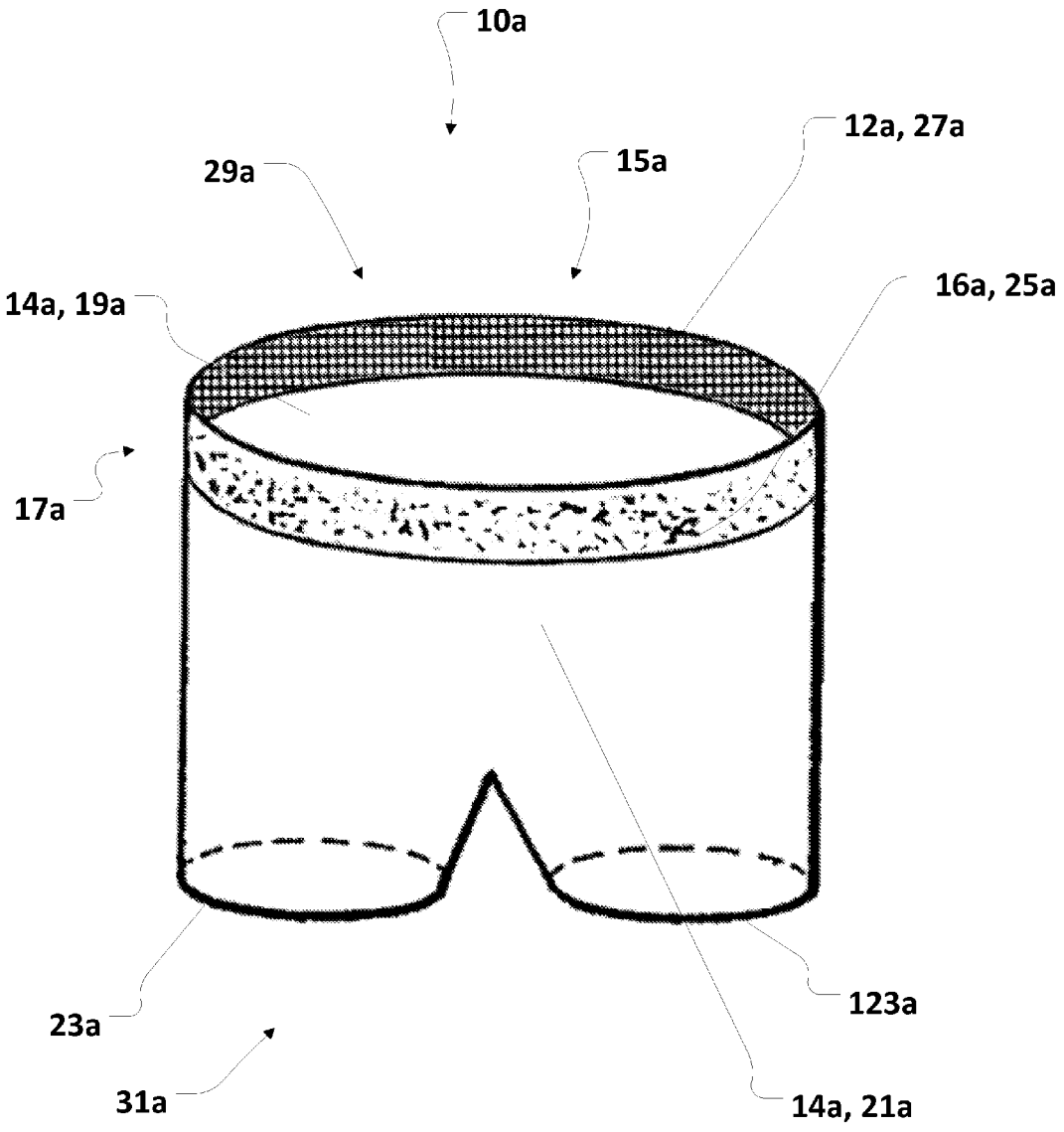
FIG. 2 is a perspective view of a garment in the form of a boxer according to an exemplary embodiment of the present disclosure.

The waistband 17 can include an exterior or outer surface 16 at least partially covered with a garment movement-inhibiting material 25 configured to prevent sliding movement of a shirt across the exterior surface 16. The waistband 17 can also include an interior or inner surface 12 at least partially covered with a garment non-inhibiting material 27. The waistband 17 can be circumferentially foldable towards the bottom 31 to selectively expose one of the garment movement-inhibiting material 25 and the garment non-inhibiting material 27. As shown in FIGS. 1 and 2, the garment movement-inhibiting material 25 and the garment non-inhibiting material 27 are disposed only on the waistband 17 and not on the body 14.

The garment movement-inhibiting material 25 disposed on the outer surface 16 is a material that functions to inhibit motion between it and another material that comes in contact with it, namely material of a shirt. The garment movement-inhibiting material 25 can be a material that inhibits motion by providing adhesive forces between it and another material or it can be a material that inhibits motion by increased sliding friction between it and another material. In the case that the garment movement-inhibiting material 25 inhibits motion by providing adhesive forces, the material can be a rubber adhesive, an acrylic blend adhesive, or other adhesion providing materials known to those in the art. In the case that the garment movement-inhibiting material 25 inhibits motion by providing increased sliding friction, the material can be low density polyethylene, silicone rubber, silicone gel, or other increased sliding friction providing materials known to those in the art.

The garment non-inhibiting material 27 disposed on the inner surface 12 can be any material that does not inhibit motion of another material that comes in contact with it. The garment non-inhibiting material 27 can be cotton, a synthetic fiber, some combination thereof, or other materials known to those in the art.

Body 14 can also be formed from a material that does not inhibit motion of another material that comes in contact with it. Body 14 can be the same material as inner surface 12 or can be different.

The garment movement-inhibiting material 25 can be permanently affixed to outer surface 16 can be removable by the wearer. In the case that the garment movement-inhibiting material 25 is permanently affixed to outer surface 16, the garment movement-inhibiting material 25 can, in one or more embodiments, be a material known in the art to be machine washable. In the case that the garment movement-inhibiting material 25 is removable, the material can be one known in the art to not be machine washable or it can be a material known to be machine washable. In the case that the garment movement-inhibiting material 25 is removable it can be reused after cleaning or can be of a disposable type.

The garment non-inhibiting material 27 can be permanently affixed to inner surface 12 can be removable by the wearer. In the case that the garment non-inhibiting material 27 is permanently affixed to inner surface 12, the garment non-inhibiting material 27 can, in one or more embodiments, be a material known in the art to be machine washable. In the case that the garment non-inhibiting material 27 is removable, the material can be one known in the art to not be machine washable or it can be a material known to be machine washable. In the case that the garment non-inhibiting material 27 is removable it can be reused after cleaning or can be of a disposable type.

The garment movement-inhibiting material 25 can be configured to cover the entire circumference of the waistband 17 or can be configured to cover only a part of the circumference. The circumferential part covered can be a front half or a back half, a random or repeating sequence of covered and uncovered parts, or a pattern such as a checkerboard, floral pattern, a pattern of geometric shapes such as diamonds, circles, or squares, or a character pattern. The character pattern can be the shape of a popular cartoon character, a company logo, or a popular icon. The circumferential part covered can be small, for example in one embodiment only 25% can be covered near the wearers hip region. In another embodiment the part covered can be large, for example 75%, including throughout the back of the wearer and near the hip region leaving only a small area uncovered near the front of the wearer.

In one embodiment of the present disclosure, the height of the waistband 17 can vary from 0.5 inches to greater than 1 inch and as large as 2 inches. A larger height provides a greater movement inhibiting ability by increasing the surface area of contact between the garment movement-inhibiting material 25 and a shirt material.

Referring now to FIG. 2, an undergarment 10*a* in the form of a boxer for inhibiting unwanted movement of a shirt during wear can include a body 14*a*, a torso opening 15*a*, and a waistband 17*a*. The body 14*a* can have an interior side 19*a* and an exterior side 21*a*. The torso opening 15*a* can be defined at a top 29*a* of the body 14*a* and a pair of leg openings 23*a*, 123*a* can be defined at a bottom 31*a* of the body 14*a*. The waistband 17*a* can extend along a circumference of the top 29*a*.

The waistband 17*a* can include an exterior or outer surface 16*a* at least partially covered with a garment movement-inhibiting material 25*a* configured to prevent sliding movement of a shirt across the exterior surface 16*a*. The waistband 17*a* can also include an interior or inner surface 12*a* at least partially covered with a garment non-inhibiting material 27*a*. The waistband 17*a* can be circumferentially foldable towards the bottom 31*a* to selectively expose one of the garment movement-inhibiting material 25*a* and the garment non-inhibiting material 27*a*.

Figures 3A, 3B, 3C:
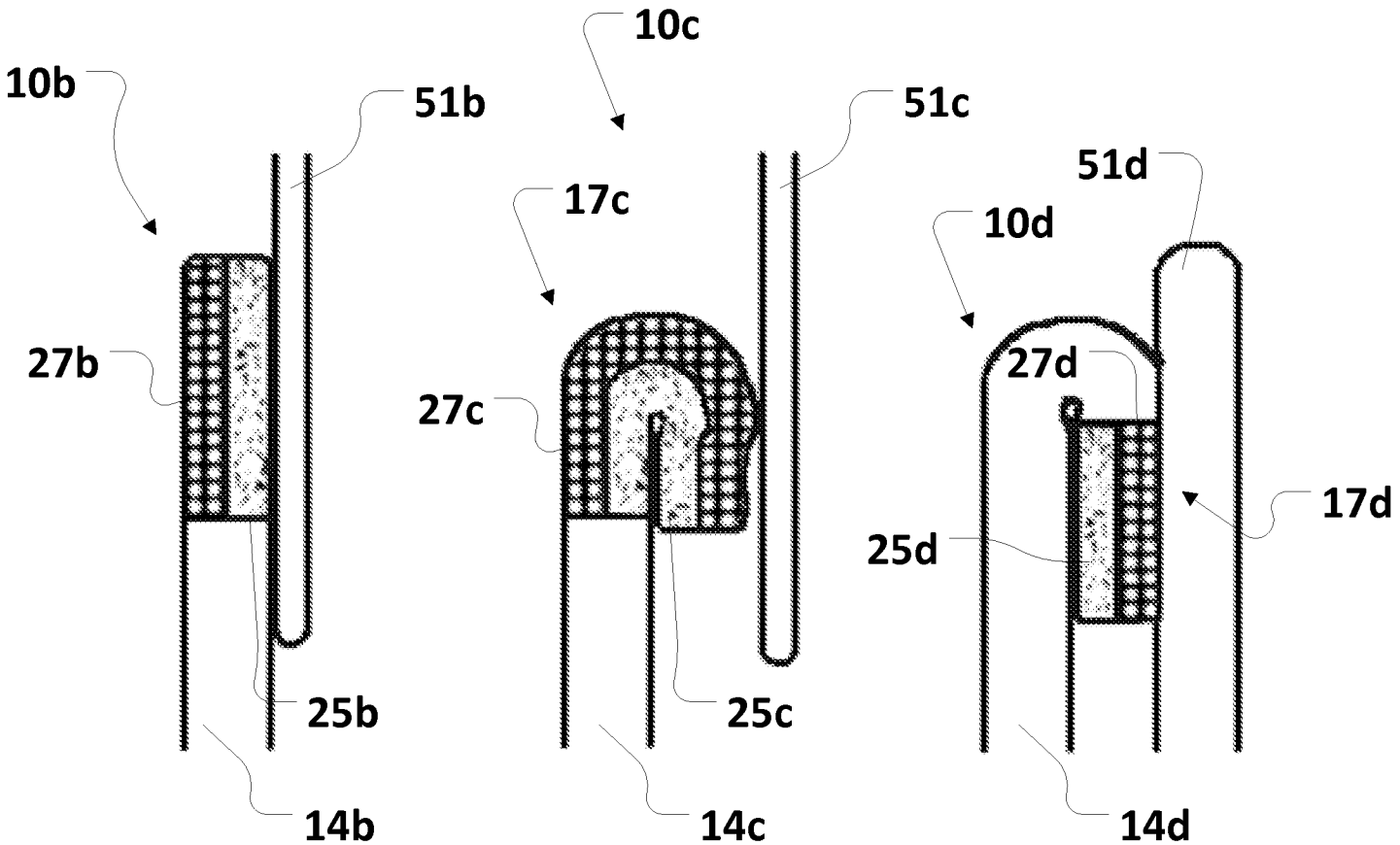
FIG. 3A is a cross sectional view of a waistband incorporating an exemplary embodiment of the present disclosure selectively enabled to retain a tucked-in shirt.
FIG. 3B is a cross sectional view of a waistband incorporating an exemplary embodiment of the present disclosure selectively disabled from retaining a tucked-in shirt.
FIG. 3C is a cross sectional view of a waistband incorporating an exemplary embodiment of the present disclosure selectively prevented from adhering to an outer garment.

Referring now to FIG. 3A, a shirt retaining undergarment 10*b* is shown having garment non-inhibiting material 27*b*, body 14*b*, and garment movement-inhibiting material 25*b* in contact with a shirt 51*b*. In this embodiment the undergarment 10*b* is configured to provide a shirt retaining function by either an increased sliding friction between the garment movement-inhibiting material 25*b* and the shirt 51*b* or adhesive forces between the same.

Referring now to FIG. 3B, a shirt retaining undergarment 10*c* with body 14*c* is configured to disable a retaining function by circumferentially folding the waistband 17*c* over to expose garment non-inhibiting material 27*c* and conceal garment movement-inhibiting material 25*c*. As a result, garment movement-inhibiting material 25*c* does not make contact with a shirt 51*c*.

Referring now to FIG. 3C, an undergarment 10*d* is again configured to prevent the shirt retaining function. The waistband 17*d* is folded over to fully expose garment non-inhibiting material 27*d*. The garment non-inhibiting material 27*d* is entirely in contact with the shirt 51*d*. The garment movement-inhibiting material 25*d* is entirely in contact with the body 14*d*.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. Further, the "present disclosure" as that term is used in this document is what is claimed in the claims of this document. The right to claim elements and/or subcombinations that are disclosed herein as other present disclosures in other patent documents is hereby unconditionally reserved.

What is claimed is:

1. An undergarment for inhibiting unwanted movement of a shirt during wear comprising:

a body having an interior side and an exterior side;

a torso opening defined at a top of said body and a pair of leg openings defined at a bottom of said body;

a waistband extending along a circumference of said top wherein said waistband includes an exterior surface at least partially covered with a garment movement-inhibiting material configured to prevent sliding movement of a shirt across said exterior surface, said waistband also including an interior surface at least partially covered with a garment non-inhibiting material, said garment movement-inhibiting material and said garment non-inhibiting material disposed only on said waistband and not said body;

said waistband being circumferentially foldable towards said bottom to selectively expose one of said garment movement-inhibiting material and said garment non-inhibiting material; and wherein said body and said garment non-inhibiting material are constructed from a different material.

2. The undergarment of claim 1, wherein said undergarment is a man's undergarment.

3. The undergarment of claim 1, wherein said undergarment is a woman's undergarment.

4. The undergarment of claim 1, wherein said waistband is configured with said garment movement-inhibiting material throughout the entire circumference of said waistband.

5. The undergarment of claim 4, wherein said garment movement-inhibiting material is reusable.

6. The undergarment of claim 1, wherein said garment movement-inhibiting material is reusable.

7. The undergarment of claim 1, wherein said waistband extends from said top towards said bottom at least 0.5 inches.

8. The undergarment of claim 1, wherein said waistband extends from said top towards said bottom at least one inch.

9. The undergarment of claim 1, wherein said waistband extends from said top towards said bottom a maximum of one inch.

10. The undergarment of claim 1, wherein said garment movement-inhibiting material is permanently affixed to said waistband.

11. The undergarment of claim 1, wherein said garment movement-inhibiting material is removably affixed to said waistband.

12. The undergarment of claim 1, wherein said body and said garment non-inhibiting material are constructed from the same material.

13. The undergarment of claim 1, wherein said garment movement-inhibiting material is configured to inhibit motion of the shirt by an increased sliding friction between said garment movement-inhibiting material and the shirt.

14. The undergarment of claim 13, wherein said garment movement-inhibiting material is composed of at least one of low density polyethylene, silicone rubber, and silicone gel.

15. The undergarment of claim 1, wherein said garment movement-inhibiting material is configured to inhibit motion of said shirt by adhesive forces between said garment movement-inhibiting material and the shirt.

16. The undergarment of claim 15, wherein said garment movement-inhibiting material is composed of at least one of rubber adhesives and acrylic blend adhesives.

17. The undergarment of claim 1, wherein said garment movement-inhibiting material and said garment non-inhibiting material are comprised of machine-washable materials.

* * * * *